US007775628B2

(12) United States Patent
Morikawa

(10) Patent No.: US 7,775,628 B2
(45) Date of Patent: Aug. 17, 2010

(54) INKJET PRINTER

(75) Inventor: Jun Morikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 641 days.

(21) Appl. No.: 11/558,689

(22) Filed: Nov. 10, 2006

(65) Prior Publication Data

US 2007/0103506 A1 May 10, 2007

(30) Foreign Application Priority Data

Nov. 10, 2005 (JP) ..... 2005-326115

(51) Int. Cl.
*B41J 23/00* (2006.01)

(52) U.S. Cl. ..... 347/37

(58) Field of Classification Search ..... 347/23, 347/37

See application file for complete search history.

(56) References Cited

U.S. PATENT DOCUMENTS 6,102,508 A * 8/2000 Cowger ..... 347/7
6,386,677 B1 * 5/2002 Imai et al. ..... 347/23

FOREIGN PATENT DOCUMENTS

JP 11-078068 3/1999
JP 11078068 3/1999

* cited by examiner

*Primary Examiner*—Stephen D Meier
*Assistant Examiner*—Alexander C Witkowski
(74) *Attorney, Agent, or Firm*—Banner & Witcoff, Ltd.

(57) ABSTRACT

An inkjet printer includes: a print head; a print data storing unit; a print executing unit; a maintaining unit; a maintenance necessity determining unit; and a printing results inquiring unit. The print head is formed with one or more ink ejection opening. The print data storing unit stores inputted print data. The print executing unit executes a printing operation with the print head based on print data stored in the print data storing unit. The maintaining unit restores the ink ejection state of the print head. The maintenance necessity determining unit determines whether or not it is necessary to perform an operation for restoring the ink ejection state with the maintaining unit. The printing results inquiring unit inquires whether to allow the printing results of a printing operation executed by the print executing unit when the maintenance necessity determining unit determines that it is necessary to restore the ink ejection state of the print head. The print data storing unit stores print data at least until a response allowing the printing results is received in response to an inquiry by the printing results inquiring unit, or at least until the maintaining unit has executed an operation to restore the ink ejection state and the print executing unit has repeated the printing operation after the printing results inquiring unit has issued an inquiry.

14 Claims, 6 Drawing Sheets

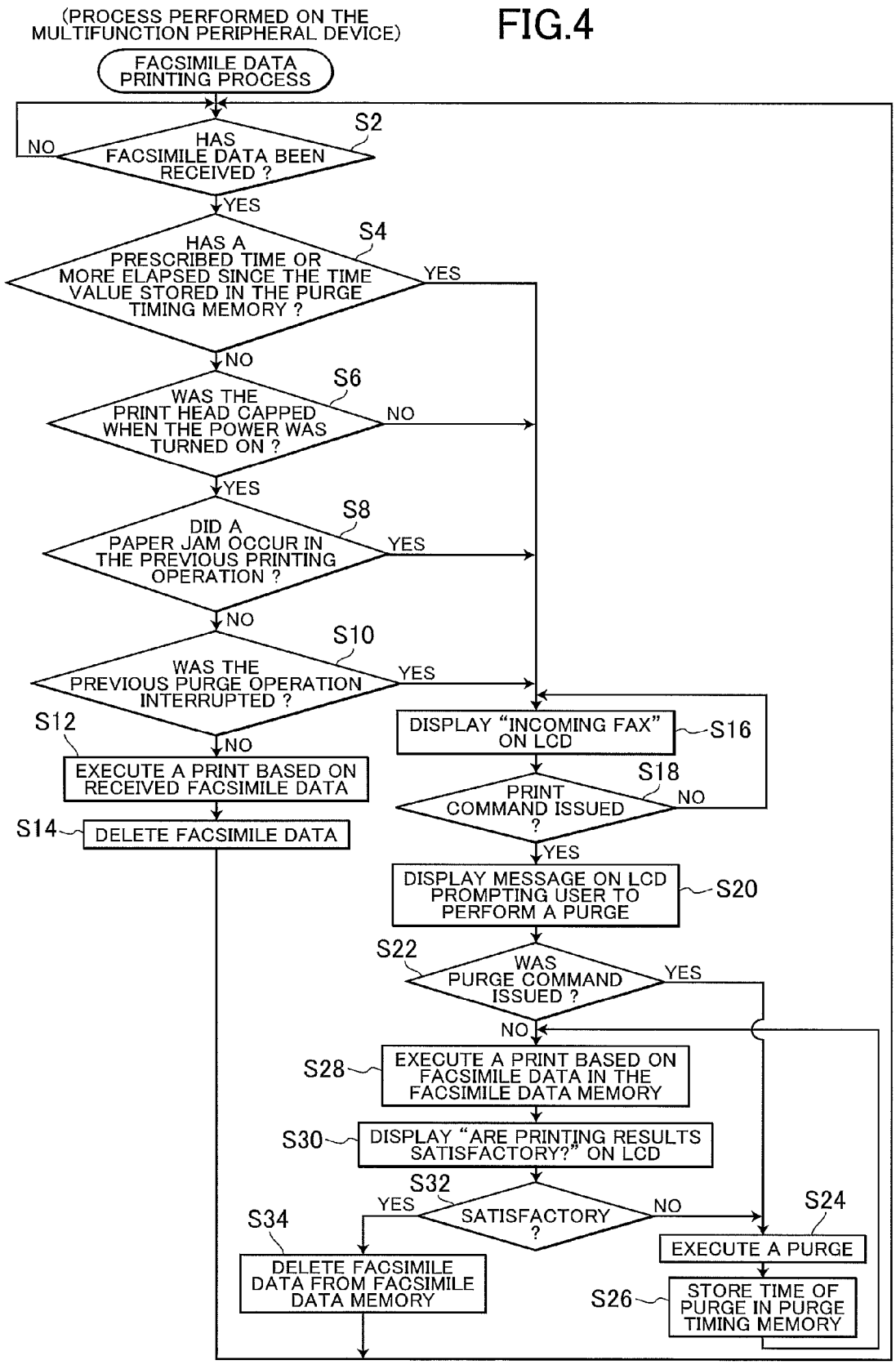
(PROCESS PERFORMED ON THE MULTIFUNCTION PERIPHERAL DEVICE)
FIG.4
FACSIMILE DATA PRINTING PROCESS
S2
HAS FACSIMILE DATA BEEN RECEIVED ?
NO
YES
S4
HAS A PRESCRIBED TIME OR MORE ELAPSED SINCE THE TIME VALUE STORED IN THE PURGE TIMING MEMORY ?
YES
NO
S6
WAS THE PRINT HEAD CAPPED WHEN THE POWER WAS TURNED ON ?
NO
YES
S8
DID A PAPER JAM OCCUR IN THE PREVIOUS PRINTING OPERATION ?
YES
NO
S10
WAS THE PREVIOUS PURGE OPERATION INTERRUPTED ?
YES
NO
S12
EXECUTE A PRINT BASED ON RECEIVED FACSIMILE DATA
S14
DELETE FACSIMILE DATA
DISPLAY "INCOMING FAX" ON LCD
S16
S18
PRINT COMMAND ISSUED ?
NO
YES
DISPLAY MESSAGE ON LCD PROMPTING USER TO PERFORM A PURGE
S20
S22
WAS PURGE COMMAND ISSUED ?
YES
NO
S28
EXECUTE A PRINT BASED ON FACSIMILE DATA IN THE FACSIMILE DATA MEMORY
S30
DISPLAY "ARE PRINTING RESULTS SATISFACTORY?" ON LCD
S32
SATISFACTORY ?
YES
NO
S34
DELETE FACSIMILE DATA FROM FACSIMILE DATA MEMORY
S24
EXECUTE A PURGE
S26
STORE TIME OF PURGE IN PURGE TIMING MEMORY

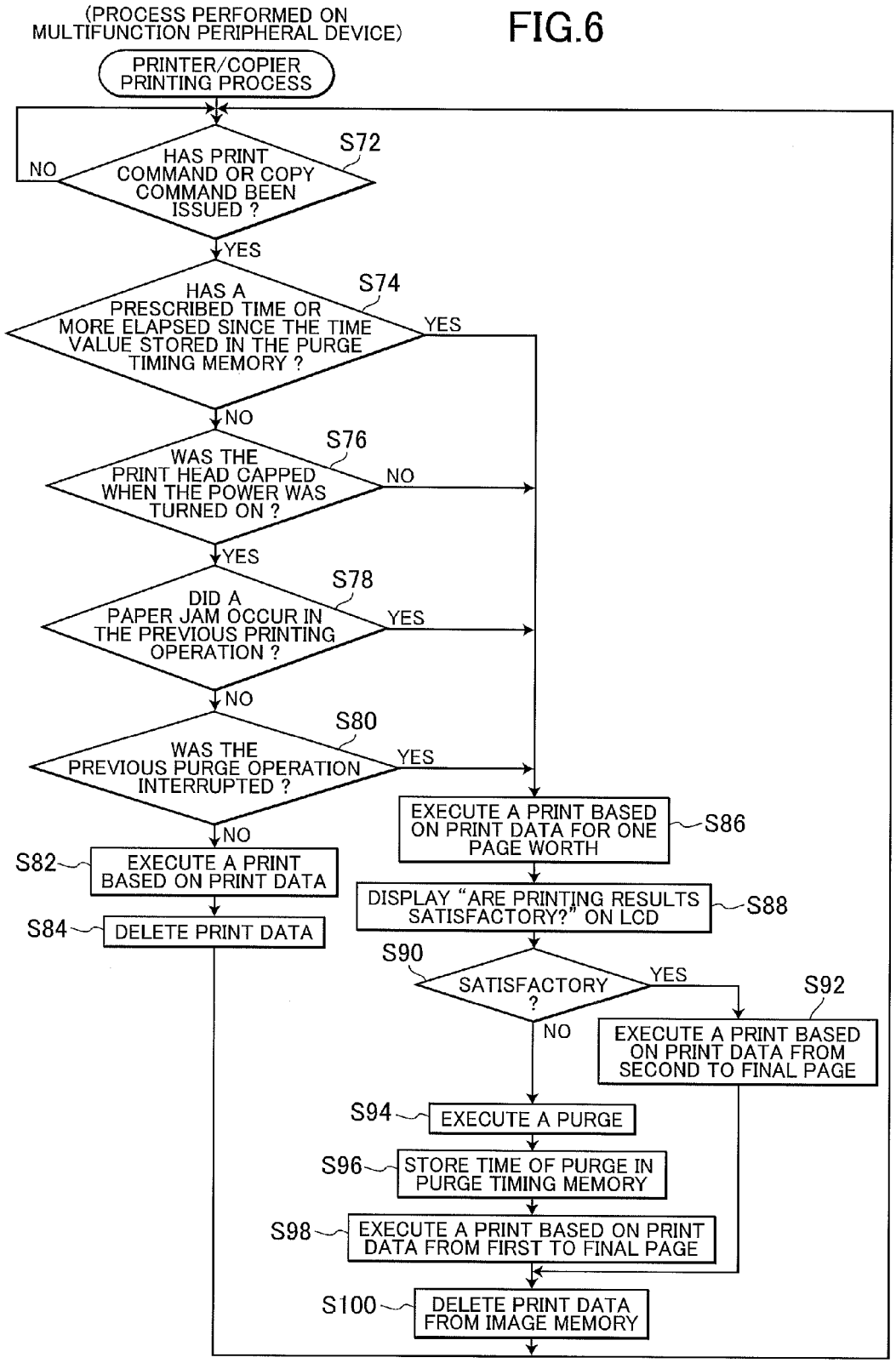
(PROCESS PERFORMED ON MULTIFUNCTION PERIPHERAL DEVICE)
FIG.6
PRINTER/COPIER PRINTING PROCESS
S72
HAS PRINT COMMAND OR COPY COMMAND BEEN ISSUED ?
NO
YES
S74
HAS A PRESCRIBED TIME OR MORE ELAPSED SINCE THE TIME VALUE STORED IN THE PURGE TIMING MEMORY ?
YES
NO
S76
WAS THE PRINT HEAD CAPPED WHEN THE POWER WAS TURNED ON ?
NO
YES
S78
DID A PAPER JAM OCCUR IN THE PREVIOUS PRINTING OPERATION ?
YES
NO
S80
WAS THE PREVIOUS PURGE OPERATION INTERRUPTED ?
YES
NO
S82
EXECUTE A PRINT BASED ON PRINT DATA
S84
DELETE PRINT DATA
EXECUTE A PRINT BASED ON PRINT DATA FOR ONE PAGE WORTH
S86
DISPLAY "ARE PRINTING RESULTS SATISFACTORY?" ON LCD
S88
S90
SATISFACTORY ?
YES
NO
S92
EXECUTE A PRINT BASED ON PRINT DATA FROM SECOND TO FINAL PAGE
S94
EXECUTE A PURGE
S96
STORE TIME OF PURGE IN PURGE TIMING MEMORY
S98
EXECUTE A PRINT BASED ON PRINT DATA FROM FIRST TO FINAL PAGE
S100
DELETE PRINT DATA FROM IMAGE MEMORY

INKJET PRINTER

CROSS REFERENCE TO RELATED APPLICATION

This application claims priority from Japanese Patent Application No. 2005-326115 filed Nov. 10, 2005, the entire content of which is incorporated herein by reference.

TECHNICAL FIELD

The disclosure relates to an inkjet printer, and particularly to an inkjet printer capable of suppressing ink consumption and capable of suppressing degradation of printing quality due to ink ejection problems.

BACKGROUND

Conventional inkjet printers print on recording paper by ejecting ink from a print head having a plurality of ink ejection openings or nozzles formed therein. In this inkjet printer, ink ejection problems can occur when air bubbles are generated in the ink while the print head is in use, when ink or microparticles of foreign matter are deposited on the surface of the ink ejection openings, and the like. Further, if the printer is left unused for a long period of time, the ink ejection openings may become clogged with ink, leading to ink ejection problems. Since printing quality suffers if a printing operation is performed while ink ejection is problematic, a purge process is generally performed to restore the ink ejection openings to a good ejection state. The purge process is performed, for example, by generating a negative pressure with a pump to draw ink out of the print head after hermetically sealing the print head with a suction cap, or performing a preliminary ejection process to eject ink from the nozzles. By executing such a purge process, it is possible to restore the ink ejection state, as disclosed in U.S. Pat. No. 6,386,677B1, for example.

SUMMARY

The user may manually execute this purge process after checking printing results and detecting problems in the printing quality. After executing the purge process, the user then re-executes the printing operation.

However, when the purge process is performed according to the method described above, printing complications occur at least once. As a result, the recording medium is wasted if the printing quality is unusable and the recording medium has to be discarded.

Further, various problems occur since the print data is already lost at the time the user notices the printing complications and re-executes the printing operation. Specifically, data transmitted from a personal computer is stored in the memory of the inkjet printer. Since the data stored in the memory is no longer necessary after the inkjet printer completes printing based on this data, the printer deletes the data in order to effectively use the memory. Hence, data that was stored in the memory has already been deleted by the time the user notices the printing complications. Accordingly, the user must return to the location of the personal computer in order to retransmit the print data to the inkjet printer and subsequently return to the inkjet printer to retrieve the printed product, increasing the user's workload and the number of operations the user must perform.

This is particularly problematic in inkjet printers having a facsimile function for receiving facsimile data from another facsimile device. Specifically, since an inkjet printer having a facsimile function deletes facsimile data from memory after the data is printed, facsimile data received from another facsimile machine is already lost by the time the user notices problems in printing. Since the inkjet printer cannot reprint the data, the user must contact the source of the facsimile transmission to request that the facsimile data be resent.

In order to resolve this problem, an inkjet printer has been proposed for automatically performing a purge process at prescribed times as also disclosed in the above-mentioned U.S. Pat. No. 6,386,677B1. This inkjet printer can reduce the occurrences of printing problems by automatically performing the purge process before such problems occur. However, when automatically performing the purge process before problems in printing occur, the purge process is performed even at times when the user can allow printing complications. Performing the purge process even when the user considers the purge process unnecessary (that is, when the user can allow printing complications) inevitably leads to an increase in the number of purge processes performed. Since the purge process restores the ink ejection state of the nozzles by ejecting or drawing ink, as described above, an increase in the number of purge processes leads to an unnecessary consumption of ink.

In view of the foregoing, it is an object of the invention to provide an inkjet printer capable of suppressing ink consumption and capable of suppressing problems related to the occurrence of printing complications.

In order to attain the above and other objects, the invention provides an inkjet printer including: a print head; a print data storing unit; a print executing unit; a maintaining unit; a maintenance necessity determining unit; and a printing results inquiring unit. The print head is formed with one or more ink ejection opening for printing on a recording medium by ejecting ink from the ink ejection opening. The print data storing unit stores inputted print data. The print executing unit executes a printing operation with the print head based on print data stored in the print data storing unit. The maintaining unit restores the ink ejection state of the print head by flowing ink through the ink ejection opening formed in the print head. The maintenance necessity determining unit determines whether or not it is necessary to perform an operation for restoring the ink ejection state with the maintaining unit. The printing results inquiring unit inquires whether to allow the printing results of a printing operation executed by the print executing unit when the maintenance necessity determining unit determines that it is necessary to restore the ink ejection state of the print head. The print data storing unit stores print data at least until a response allowing the printing results is received in response to an inquiry by the printing results inquiring unit, or at least until the maintaining unit has executed an operation to restore the ink ejection state and the print executing unit has repeated the printing operation after the printing results inquiring unit has issued an inquiry.

According to another aspect, the invention provides an inkjet printer including: a print data storing unit; a print head; a maintaining unit; a maintenance necessity determining unit; a partial print executing unit; a printing results inquiring unit; and a remaining print executing unit. The print data storing unit stores inputted print data. The print head is formed with one or more ink ejection opening for printing on a recording medium based on the print data stored in the print data storing unit by ejecting ink through the ink ejection opening. The maintaining unit restores the ink ejection state of the print head by flowing ink through the ink ejection opening formed in the print head. The maintenance necessity determining unit determines whether or not it is necessary to perform an operation for restoring the ink ejection state with the maintaining unit. The partial print executing unit executes a printing operation based on a part of print data stored in the print data storing unit when the maintenance necessity determining unit determines that an operation for restoring the ink ejection state is required. The printing results inquiring unit issues an inquiry regarding whether to allow printing results of the partial print executing unit. The remaining print executing unit executes, when a response to an inquiry by the printing results inquiring unit indicates that the printing results are allowed, a printing operation based on a remaining part of the print data that is stored in the print data storing unit but that has not been printed by the partial print executing unit.

According to another aspect, the invention provides a method of maintaining an ink ejection state of a print head in an inkjet printer, the inkjet printer including the print head formed with one or more ink ejection opening for printing on a recording medium by ejecting ink from the ink ejection opening, a print data storing unit that stores inputted print data, a print executing unit that executes a printing operation with the print head based on print data stored in the print data storing unit, and a maintaining unit that restores the ink ejection state of the print head by flowing ink through the ink ejection opening formed in the print head. The method includes: determining whether or not it is necessary to perform an operation for restoring the ink ejection state with the maintaining unit; inquiring whether to allow the printing results of a printing operation executed by the print executing unit when it is determined that it is necessary to restore the ink ejection state of the print head; and storing print data at least until a response allowing the printing results is received in response to an inquiry by the printing results inquiring unit, or at least until the maintaining unit has executed an operation to restore the ink ejection state and the print executing unit has repeated the printing operation after the printing results inquiring unit has issued an inquiry.

BRIEF DESCRIPTION OF THE DRAWINGS

Illustrative aspects in accordance with the invention will be described in detail with reference to the following figures wherein:

FIG. 4 is a flowchart illustrating steps in a facsimile data printing process executed on the multifunction peripheral device;

FIG. 6 is flowchart illustrating steps in a printing process for a printer function or a copier function according to a third embodiment.

DETAILED DESCRIPTION

Figure 1:
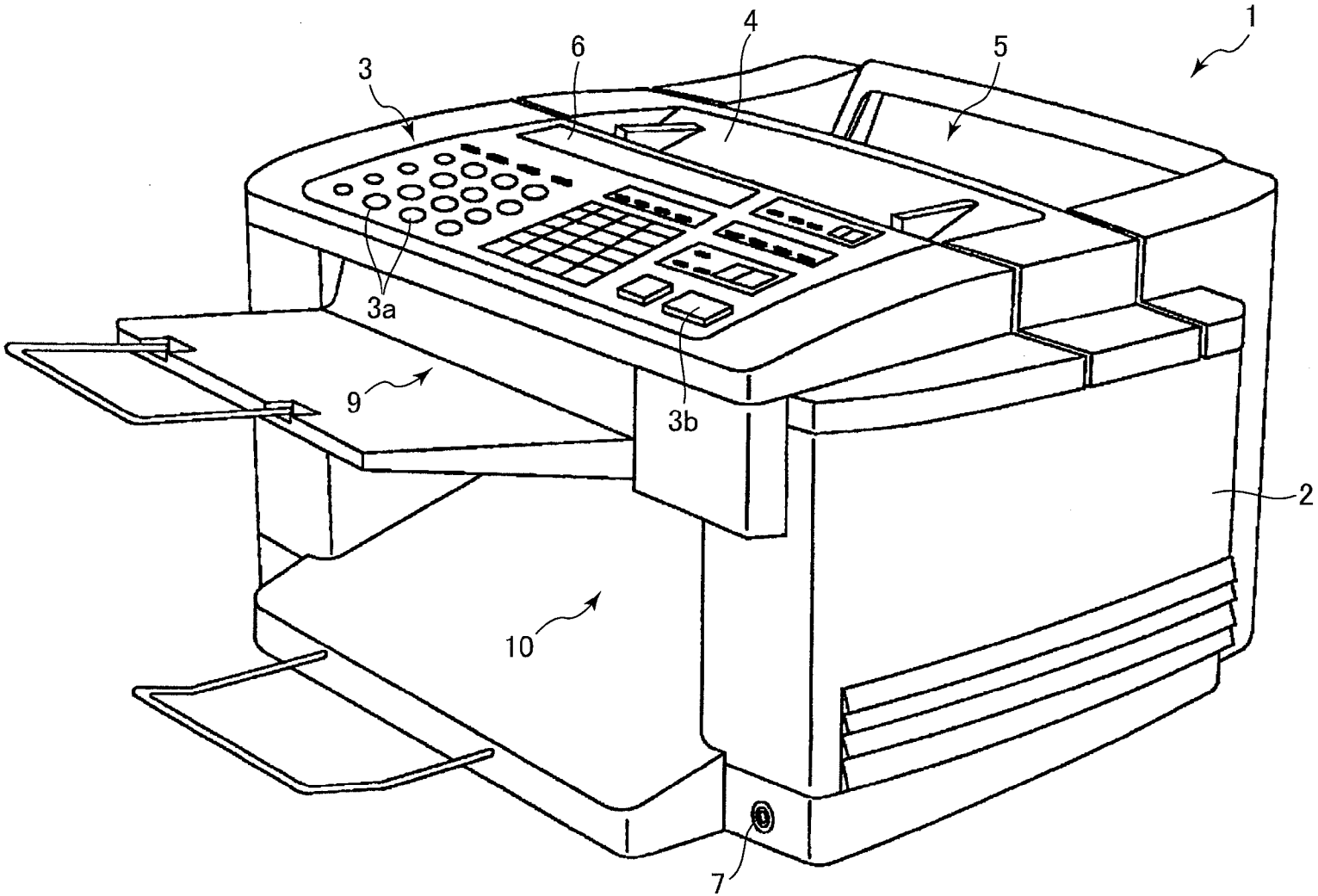
FIG. 1 is a perspective view of a multifunction peripheral device according to a first embodiment of the invention.

An inkjet printer according to some aspects of the invention will be described while referring to the accompanying drawings wherein like parts and components are designated by the same reference numerals to avoid duplicating description.

FIG. 1 is a perspective view of a multifunction peripheral device 1 according to a first embodiment of the invention. The multifunction peripheral device 1 includes such functions as a facsimile function, printer function, scanner function, copier function, and video printer function. The multifunction peripheral device 1 is equipped with an inkjet printer 26 (see FIG. 2) with a full-color printing capacity for printing operations performed with these functions.

As shown in FIG. 1, the multifunction peripheral device 1 includes a main body 2 having a box-like shape. A control panel 3 is disposed on the upper front edge of the main body 2. The control panel 3 includes numerical buttons 3*a* for the numbers 0-9, a start button 3*b*, and various other buttons. The user can implement various operations by pressing these buttons. For example, the user operates buttons on the control panel 3 when initializing the current time, described later. A liquid crystal display (LCD) 6 is disposed in the rear portion of the control panel 3 for displaying settings of the multifunction peripheral device 1, various operating messages, and the like as needed. When the multifunction peripheral device 1 is in a standby state, for example, the LCD 6 displays the current time set via the control panel 3.

An original-supporting part 4 is provided to the rear of the LCD 6 for supporting in a stacked state a facsimile original to be transmitted to another facsimile machine 51 (see FIG. 3) when using the facsimile function or a copy original to be copied when using the copier function. The originals placed on the original-supporting part 4 are conveyed inside the main body 2, where a scanner 19 (see FIG. 3) scans images from the surface of the originals. After the scanning operation, the originals are conveyed further and discharged in a stacked state onto an original discharge unit 9 disposed below the control panel 3.

A cassette insertion part 5 is disposed rearward of the original-supporting part 4. A paper cassette (not shown) capable of accommodating a plurality of sheets of a recording paper P (see FIG. 2) in a stacked state can be detachably mounted in the cassette insertion part 5. The recording paper P is supplied from the paper cassette mounted in the cassette insertion part 5 into the main body 2. After the inkjet printer 26 described later performs a printing operation on the recording paper P, the recording paper P is discharged through a recording paper discharge unit 10 disposed below the original discharge unit 9. A video signal input terminal 7 is disposed adjacent to the right lower portion of the recording paper discharge unit 10. When a video camera or the like is connected to the video signal input terminal 7, a video signal (image data) outputted from the video camera is inputted into the multifunction peripheral device 1 and printed in full color with the inkjet printer 26.

Figure 2:
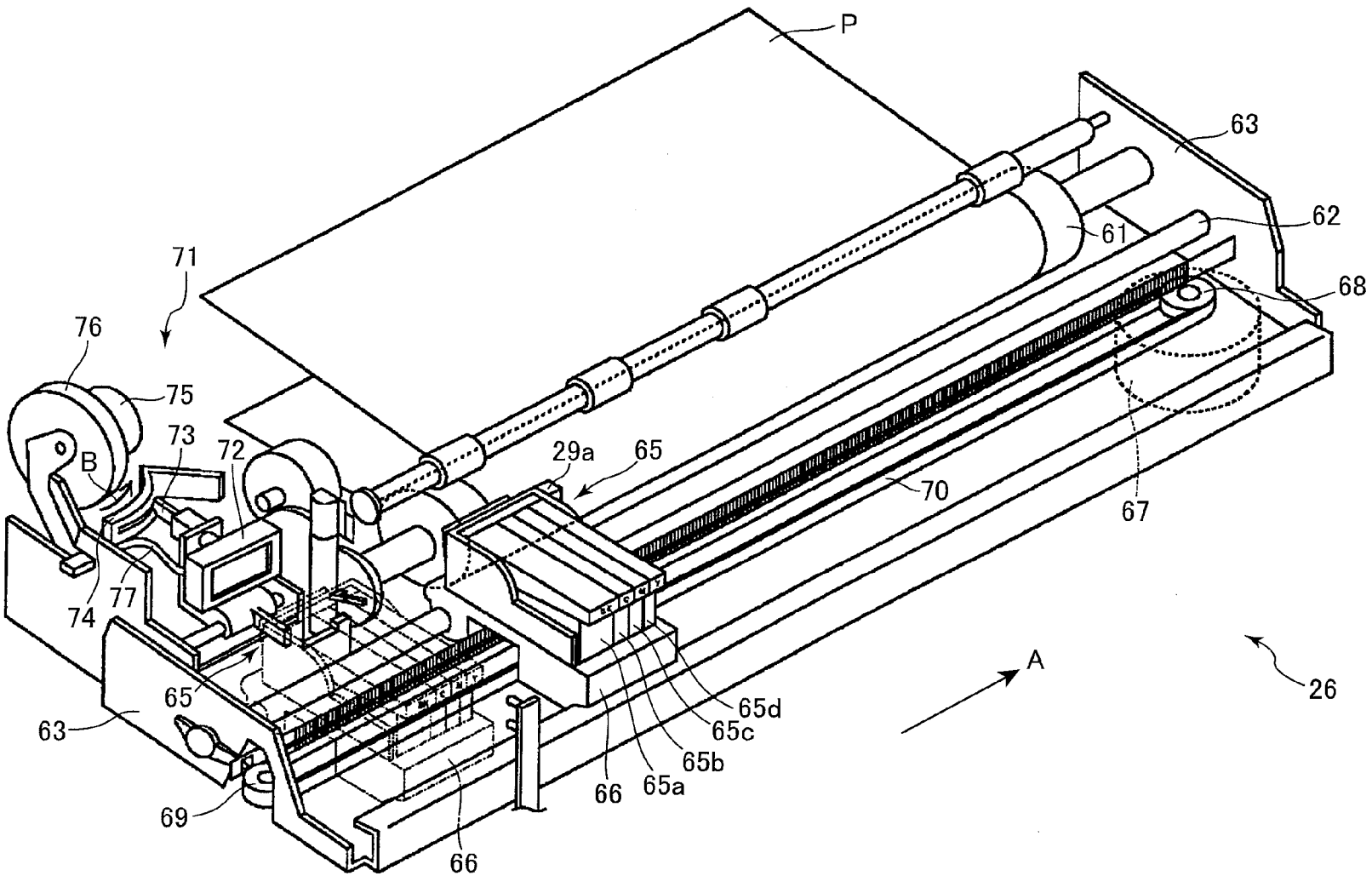
FIG. 2 is a perspective view of an inkjet printer housed within the main body of the multifunction peripheral device.

FIG. 2 is a perspective view of the inkjet printer 26 accommodated in the main body 2 of the multifunction peripheral device 1. The inkjet printer 26 is a serial printer that prints on a recording medium by moving a print head 65 in the direction A indicated in FIG. 2 and the direction opposite the direction A.

The inkjet printer 26 has a frame 63. A platen roller 61 is rotatably mounted in the frame 63 for conveying the recording paper P. A guide rod 62 is fixed to the frame 63 parallel to the platen roller 61. A carriage 66 supporting the print head 65 is supported on the guide rod 62 so as to be capable of moving in a direction orthogonal to the conveying direction of the recording paper P. The carriage 66 is moved over the guide rod 62 parallel to the platen roller 61 by a belt 70. The belt 70 is looped around a drive pulley 68 and a follow pulley 69. A carriage motor 67 is provided on one side of the frame 63 for driving the drive pulley 68 to rotate.

The print head 65 mounted on the carriage 66 includes ink tanks 65*a*-65*d* corresponding to each of four colors. Specifically, the ink tanks 65*a*-65*d* are filled with ink of the colors black, cyan, magenta, and yellow in order from the left side in FIG. 2. Full-color printing is performed on the recording paper P by ejecting ink of these four colors through a plurality of nozzles (ink ejection openings) provided in the print head 65. The ink tanks 65*a*-65*d* can be mounted and detached independently, making it possible to replace only the ink tanks with insufficient ink.

A recovery mechanism 71 for restoring the ink ejection state of the nozzles is disposed on the left side of the frame 63 in FIG. 2. The recovery mechanism 71 includes a suction cap 72 for forming a hermetic seal over all of the nozzles in the print head 65; and a protruding member 73 mounted on the back surface of the suction cap 72 for extending the suction cap 72 in a direction toward the print head 65. One end of the protruding member 73 contacts a surface of a protruding lever 74 that is formed in an arc shape. When the protruding lever 74 moves in the direction B from the state shown in FIG. 2, the suction cap 72 protrudes together with the protruding member 73 toward the print head 65. Accordingly, after the carriage 66 is moved to the position indicated by dotted lines in FIG. 2, the nozzle portion of the print head 65 can be covered by the suction cap 72 and hermetically sealed by moving the protruding lever 74 in the B direction. When the power of the multifunction peripheral device 1 is turned off, the suction cap 72 covers and hermetically seals the nozzle portion of the print head 65, preventing ink in the nozzles from drying out.

The recovery mechanism 71 also includes a cam 76, and a motor 75 for rotating the cam 76 to move the protruding lever 74 in the B direction and the direction opposite the B direction. The rotation of the cam 76 also drives a suction pump (not shown). The suction pump functions to draw out ink via suction tubes 77 connected to the rear surface, or non-suction surface, of the suction cap 72. The suction pump is operated when the suction cap 72 covers the print head 65 in order to draw out ink from nozzles in the print head 65 and restore the ink ejection state of the print head 65.

Figure 3:
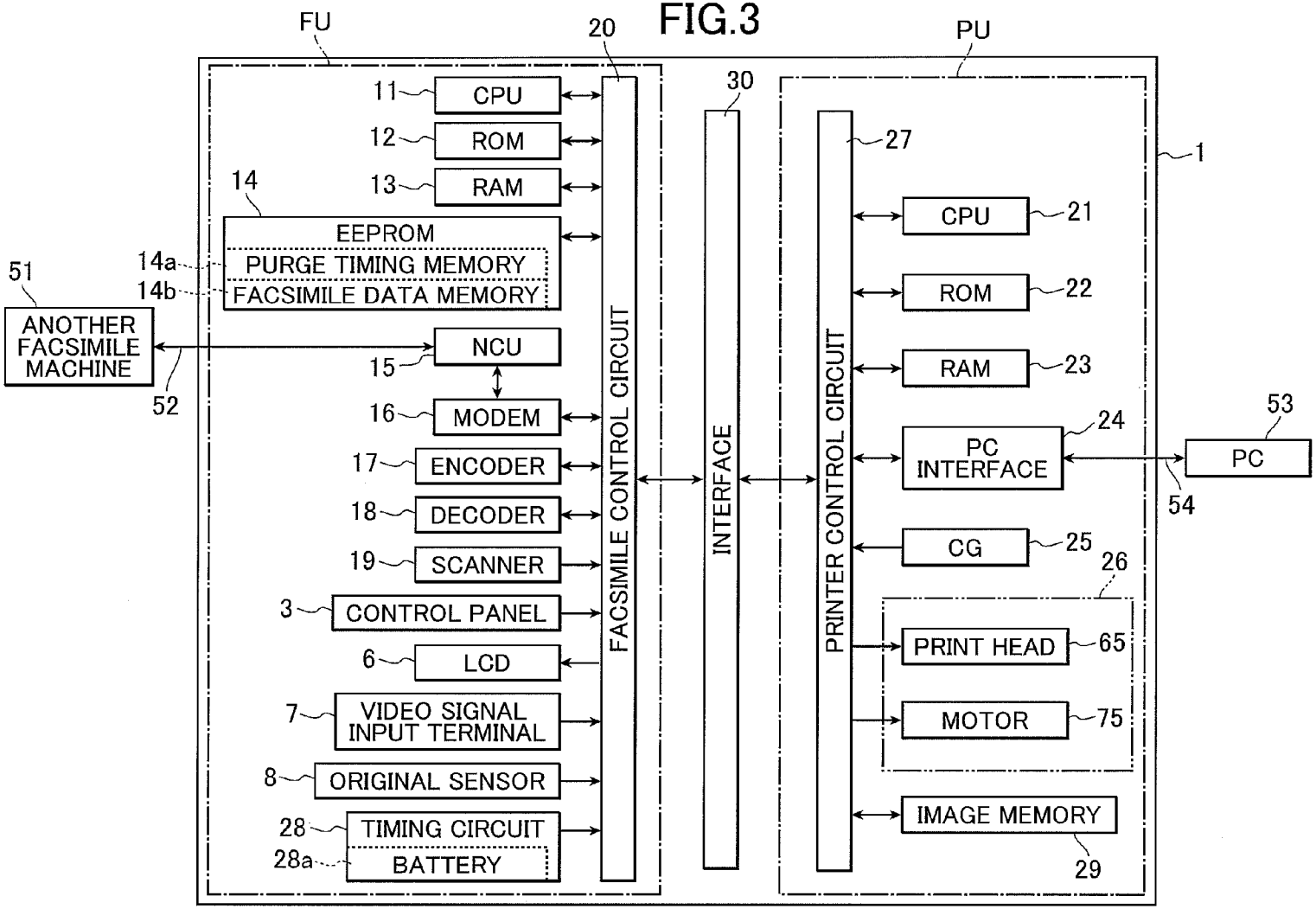
FIG. 3 is a block diagram showing the electrical configuration of the multifunction peripheral device.

FIG. 3 is a block diagram showing the electrical configuration of the multifunction peripheral device 1. The multifunction peripheral device 1 is configured of a facsimile unit FU and a printer unit PU that are connected to each other via an interface 30. The facsimile unit FU includes a CPU 11, a ROM 12, a RAM 13, an EEPROM 14, a network control unit (NCU) 15, a modem 16, an encoder 17, a decoder 18, the scanner 19, the control panel 3, the LCD 6, the video signal input terminal 7, an original sensor 8, and a timing circuit 28, all of which components are connected to each other via a facsimile control circuit 20.

The CPU 11 controls each of the components connected to the facsimile control circuit 20 based on signals exchanged via the NCU 15 for executing a facsimile operation and the like. The ROM 12 is a non-writable memory storing various control programs and the like that are executed on the multifunction peripheral device 1. The RAM 13 is a rewritable memory for temporarily storing various data. The EEPROM 14 is a rewritable, nonvolatile memory. Hence, data stored in the EEPROM 14 can be saved even after the power to the multifunction peripheral device 1 is turned off. The EEPROM 14 includes a purge timing memory 14*a*, and a facsimile data memory 14*b*. The purge timing memory 14*a* stores the time and date of the most recently performed purge process.

The facsimile data memory 14*b* stores facsimile data received from the facsimile machine 51 and decoded by the decoder 18. As will be described later with reference to FIG. 4, the facsimile data stored in the facsimile data memory 14*b* is deleted from the facsimile data memory 14*b* after the inkjet printer 26 has performed a printing operation on recording paper based on the data, provided that there is no risk of printing complications occurring, even when the purge process is not executed. Since the facsimile data is deleted under the condition that a printing operation based on the data has been completed, the facsimile data memory 14*b* can be used effectively. However, if a purge process is required and there is a danger that printing complications will occur unless the purge process is executed, the facsimile data is not deleted from the facsimile data memory 14*b* after the inkjet printer 26 has executed the printing operation.

The NCU 15 performs operations to transmit a dial signal to a telephone line 52, and to respond to a call signal from the telephone line 52. The modem 16 modulates and demodulates image data and transmits the modulated data to the facsimile machine 51 via the NCU 15 or exchanges procedure signals for controlling transmissions with the facsimile machine 51. The encoder 17 functions to compress image data of an original or the like read by the scanner 19, while the decoder 18 functions to decode encoded data such as received facsimile data. The decoded facsimile data is stored in the facsimile data memory 14*b*. The scanner 19 functions to scan images from originals inserted into the multifunction peripheral device 1 from the original-supporting part 4. The original sensor 8 functions to detect the presence of an original placed on the original-supporting part 4.

The timing circuit 28 is a circuit that keeps track of the current date and time. The timing circuit 28 includes a battery 28*a* for enabling the timing circuit 28 to continue keeping track of the current time after the power to the multifunction peripheral device 1 has been turned off. The user sets the initial current time in the timing circuit 28 through the control panel 3. The current time in the timing circuit 28 is outputted to and displayed on the LCD 6 when the multifunction peripheral device 1 is in a standby state, that is, when operating functions of the multifunction peripheral device 1 have been halted. After a purge process, the printer unit PU reads the current time in the timing circuit 28 and writes this time to the purge timing memory 14*a* of the EEPROM 14.

The facsimile unit FU is connected to the facsimile machine 51 via the NCU 15 and the telephone line 52.

The printer unit PU includes a CPU 21 that functions as a processor; a ROM 22 for storing control programs and the like executed by the CPU 21, including a program for a printing process shown in the flowchart of FIG. 4; a RAM 23 having various work areas that are referenced and updated by the CPU 21 when the CPU 21 executes control programs, a print memory storing print data, and the like; a PC interface 24 for connecting a host device such as a personal computer 53; a character generator 25 for storing vector fonts of characters and the like being printed; the inkjet printer 26 described above; and an image memory 29. The above components are connected to one another via a printer control circuit 27. In FIG. 3, only the print head 65 and the motor 75 of the inkjet printer 26 have been indicated, while the remaining structure has been omitted. The PC interface 24 is a parallel interface based on the Centronics standard, for example. The multifunction peripheral device 1 can exchange data with the personal computer 53 via a cable 54 connected to the PC interface 24.

The image memory 29 functions to store communication history, image data, and bit images for printing. The image memory 29 is configured of dynamic RAM (DRAM), which is an inexpensive large-capacity memory. Image data received by the printer unit PU is temporarily stored in the image memory 29. The image data is deleted from the image memory 29 after the inkjet printer 26 prints an image based on the image data on recording paper. Since image data is generally large in volume, the image memory 29 can be effectively used by deleting this image data after the data has been printed.

Next, a process for printing facsimile data executed by the multifunction peripheral device 1 having the structure described above will be described with reference to FIG. 4. FIG. 4 is a flowchart illustrating steps in the facsimile data printing process executed on the multifunction peripheral device 1. This process is executed when printing facsimile data.

In S2 of FIG. 4, the multifunction peripheral device 1 determines whether or not facsimile data has been received. When facsimile data has not been received (S2: NO), the process of S2 is repeated. The received facsimile data is decoded by the decoder 18 and stored in the facsimile data memory 14*b*.

When facsimile data is received (S2: YES), in S4-S10 the multifunction peripheral device 1 (CPU 21) determines whether or not a purge process is necessary based on whether or not prescribed conditions have been met. For example, the multifunction peripheral device 1 determines that a purge process is unnecessary if the current time read from the timing circuit 28 does not indicate that a prescribed time, such as 20 days, has elapsed since a value read from the purge timing memory 14*a* (the time at which the last purge process was executed; S4: NO); the nozzle portion of the print head 65 was covered and hermetically sealed by the suction cap 72 when the power to the multifunction peripheral device 1 was turned on (S6: YES); a paper jam did not occur in the previous printing operation (S8: NO); and the previous purge process was not interrupted, but was performed normally (S10: NO). In this case, the multifunction peripheral device 1 executes a printing operation in S12 based on the received facsimile data. After the printing operation, in S14 the multifunction peripheral device 1 deletes the facsimile data from the facsimile data memory 14*b*. In the printing operation of S12, the multifunction peripheral device 1 prints all pages from the first page to the last page.

On the other hand, if the multifunction peripheral device 1 determines that a prescribed time, such as 20 days or more, has elapsed since the value read from the purge timing memory 14*a* (the time the previous purge process was executed) based on the current time read from the timing circuit 28 (S4: YES), then it is likely that ink or particles of foreign matter have accumulated in the nozzle portion of the print head 65 since the previous purge process. Accordingly, the multifunction peripheral device 1 determines that a purge process is necessary and advances to S16.

Further, if the multifunction peripheral device 1 determines that the suction cap 72 was not covering the nozzle portion of the print head 65 when the power to the multifunction peripheral device 1 was turned on (S6: NO), then it is likely that ink deposited in the nozzle portion of the print head 65 has dried. Accordingly, the multifunction peripheral device 1 determines that a purge process is necessary and advances to S16. This process may be configured to skip S6, even when the multifunction peripheral device 1 determines that the suction cap 72 was not covering the print head 65 when the multifunction peripheral device 1 was powered on, if the multifunction peripheral device 1 executes the purge process one or a plurality of times after the power was turned on and subsequently determines that a purge process is unnecessary.

Further, if a paper jam had occurred during the previous printing operation (S8: YES), then it is conceivable that ink was deposited on the nozzle portion of the print head 65 due to contact by the recording paper P or the like. Accordingly, the multifunction peripheral device 1 determines that a purge process is necessary and advances to S16.

Further, if the previous purge process was halted in the middle of the operation, that is, if the user turned off the power during the previous purge process, for example, preventing the purge process from ending normally, then the multifunction peripheral device 1 determines that a purge process is necessary and advances to S16.

When the multifunction peripheral device 1 determines that a purge process is necessary based on the prescribed conditions indicating the necessity of a purge process being met, as described above, in S16 the multifunction peripheral device 1 displays the message "Incoming FAX" on the LCD 6. In this way, the multifunction peripheral device 1 can notify the user that there is facsimile data to be printed.

In S18 the multifunction peripheral device 1 determines whether or not the user has issued a command to perform a printing operation. If a print command has not been issued (S18: NO), then the multifunction peripheral device 1 returns to S16. However, if a print command has been issued (S18: YES), then in S20 the multifunction peripheral device 1 displays a message on the LCD 6 prompting the user to perform a purge process, such as "Please perform a purge operation." By notifying the user when it is time to execute a purge process in this way, the user can be informed that undesirable printing results may occur if the purge process is not performed.

In S22 the multifunction peripheral device 1 determines whether or not the user has issued a command to execute the purge process. Specifically, the multifunction peripheral device 1 determines whether or not the user has performed a prescribed key operation on the control panel 3 corresponding to issuing a command to perform a purge process. If the user issues a command to perform the purge process to avoid undesirable printing results (S22: YES), in S24 the multifunction peripheral device 1 executes the purge process to restore the ink ejection state of the print head 65 by drawing ink from the nozzles of the print head 65. Thus, the ink ejection state of the print head 65 is restored by positively flowing ink through the nozzles. After performing the purge process, in S26 the multifunction peripheral device 1 writes the current time from the timing circuit 28 to the purge timing memory 14*a*, updating the time at which the purge process was performed from the previous purge process.

Next, in S28 the multifunction peripheral device 1 performs a printing operation based on the facsimile data stored in the facsimile data memory 14*b*. In the printing operation of S28 the multifunction peripheral device 1 prints all of the facsimile data from the first page to the last page. Since the purge process was executed before this printing operation in S24, it is highly unlikely that printing problems will occur and highly likely that the printing results will be satisfactory to the user.

On the other hand, in some cases the user may not issue a command to execute the purge process despite the message displayed on the LCD 6 in S20 prompting the user to perform the purge process. The user may make this choice because the purge process draws ink from the print head 65, accelerating ink consumption, or because the user determines that the printing quality is allowable after considering the content and intended use of the printing results. Hence, if the user does not issue a command to execute the purge process (S22: NO), then in S28 the multifunction peripheral device 1 prints the facsimile data without executing the purge process. While there is a possibility that printing quality will suffer by not executing the purge process, the user has decided not to execute the purge process despite being notified to do so.

Therefore, any printing complications are not likely to cause problems with the user since the user has considered a certain degree of printing complications to be allowable.

In S30 the multifunction peripheral device 1 displays a method such as "Are the printing results satisfactory?" on the LCD 6, prompting the user to indicate whether or not the printing results are allowable. The user responds to this inquiry by performing a prescribed operation on the control panel 3. If the user responds that the printing results are allowable, that is, if the user indicates "satisfactory" (S32: YES), then in S34 the multifunction peripheral device 1 deletes the facsimile data from the facsimile data memory 14*b* and returns to S2.

However, if the user responds that the printing results are "not satisfactory" (S32: NO), then in S24 the multifunction peripheral device 1 executes the purge process. By automatically performing the purge process when the user indicates that the printing results are not allowable, the multifunction peripheral device 1 can reduce the user's operational load.

After the multifunction peripheral device 1 updates the time at which the purge process was executed in the purge timing memory 14*a* in S26 and re-executes the printing operation based on the facsimile data in S28, in S30 the multifunction peripheral device 1 again asks the user whether or not the printing results are allowable. The process of S24-S30 is repeated until a response is obtained from the user indicating that the printing results are allowable. When the user indicates that the printing results are allowable (S32: YES), in S34 the multifunction peripheral device 1 deletes the facsimile data from the facsimile data memory 14*b* and returns to S2. If the ink ejection state is particularly poor, it may not be possible to obtain acceptable printing results with just one purge process. Therefore, the facsimile data printing process of the first embodiment repeats the purge process until obtaining printing results that are allowable by the user, thereby reliably obtaining acceptable printing results.

Since the multifunction peripheral device 1 of the first embodiment does not delete facsimile data before receiving a response from the user indicating that the printing results are allowable, the multifunction peripheral device 1 can reliably obtain acceptable printing results.

As described above, since no major problems occur even when printing complications occur due to not executing the purge process, the user can perform the purge process after viewing the printing results and noticing printing complications. As a result, the multifunction peripheral device 1 of the embodiment can reduce the number of times the purge process is executed, thereby suppressing ink consumption.

Next, a facsimile data printing process executed on the multifunction peripheral device 1 according to a second embodiment will be described with reference to FIG. 5. In the first embodiment described above, the multifunction peripheral device 1 prints all pages based on the facsimile data and subsequently determines whether or not the printing results are allowable. In the second embodiment, the multifunction peripheral device 1 first executes a printing operation for one page worth based on the facsimile data and subsequently determines whether or not the printing results are satisfactory. Further, in the first embodiment described above, if the response from the user indicates that printing results are not allowable, the multifunction peripheral device 1 repeatedly executes the printing operation until a response is received indicating that the printing results are allowable. However, when a response is received from the user indicating that the printing results are not allowable in the second embodiment, the multifunction peripheral device 1 executes the purge process and subsequently re-executes the printing operation only one time. Further, in the first embodiment described above, the facsimile data is saved in the facsimile data memory 14*b* until a response is received from the user indicating that the printing results are allowable. However, in the second embodiment the facsimile data is saved in the facsimile data memory 14*b* until all pages of the facsimile data are printed. In the second embodiment described below, like parts and components are designated with the same reference numerals to avoid duplicating description.

Figure 5:
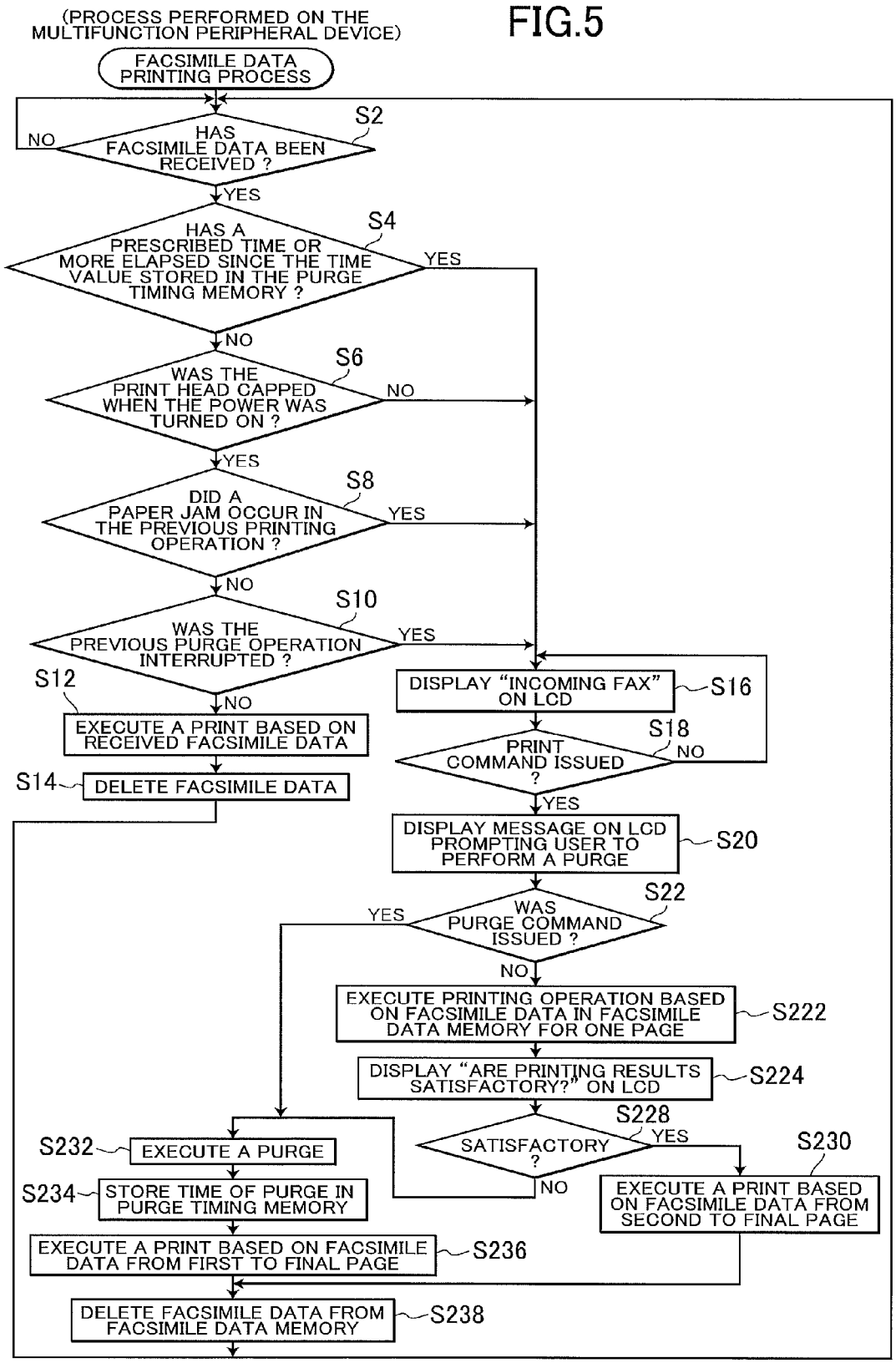
FIG. 5 is flowchart illustrating steps in a facsimile data printing process according to a second embodiment.

FIG. 5 is a flowchart illustrating steps in a facsimile data printing process of the second embodiment. In the second embodiment, steps S24-S34 of the process described in the first embodiment have been replaced with steps S222-S238. The remaining steps in the process of the second embodiment are identical to the process of the first embodiment shown in FIG. 4.

More specifically, in the facsimile data printing process according to the second embodiment, after the multifunction peripheral device 1 displays a message on the LCD 6 in S20 prompting the user to perform a purge process, the multifunction peripheral device 1 determines in S22 whether or not the user has issued a command to execute the purge process. If the user has issued a command to perform the purge process (S22: YES), then in S232 the multifunction peripheral device 1 executes a purge process to restore the ink ejection state by drawing ink out of the nozzles in the print head 65. After completing the purge process, in S234 the multifunction peripheral device 1 writes the current time from the timing circuit 28 to the purge timing memory 14*a*, updating the time for the previous purge process to the current time of the current purge process.

In S236 the multifunction peripheral device 1 executes a printing operation based on facsimile data stored in the facsimile data memory 14*b* from the first page to the final page. Since a purge process was executed in S232 prior to the printing operation in this case, it is highly unlikely that printing complications will occur and highly likely that satisfactory printing results will be obtained. Therefore, in S238 the multifunction peripheral device 1 deletes the facsimile data from the facsimile data memory 14*b* and returns to S2.

However, if the user does not issue a command to execute the purge process (S22: NO), then in S222 the multifunction peripheral device 1 prints the facsimile data without executing the purge process. Since there is a chance that problems will occur in printing without executing the purge process, only the first page worth of facsimile data is printed in S222.

In S224 the multifunction peripheral device 1 displays a message such as "Are the printing results satisfactory?" on the LCD 6, asking the user whether or not the printing results are allowable. The user responds by performing a prescribed operation on the control panel 3. If the user responds that the printing results are satisfactory (S228: YES), then in S230 the multifunction peripheral device 1 performs printing operation on the remainder of the facsimile data that has not been printed in S222. In other words, the multifunction peripheral device 1 prints all pages from the second page to the final page. Hence, since the first page was printed in S222 and the printing results were determined allowable, the multifunction peripheral device 1 continues printing from the second page to the final page. In this way, satisfactory printing results are obtained for all pages by combining the printing results for the process of S222 and the printing results for the process of S230. Therefore, the multifunction peripheral device 1 deletes the facsimile data from the facsimile data memory 14*b* in S238 and returns to S2.

On the other hand, if the response from the user is "Not satisfactory," indicating that the printing results are not allowable (S228: NO), then in S232 the multifunction peripheral device 1 executes the purge process. By automatically executing the purge process when the response from the user indicates that the printing results are not allowable in this way, the multifunction peripheral device 1 reduces the operational load placed on the user. In S234 the multifunction peripheral device 1 updates the time at which the purge process is executed in the purge timing memory 14*a*.

In S236 the multifunction peripheral device 1 executes a printing operation based on the facsimile data stored in the facsimile data memory 14*b* from the first page to the last page. Since a purge process was performed in S232 prior to the printing operation in this case, it is highly unlikely that there will be any printing complications and highly likely that the printing results will be satisfactory. Hence, in S238 the multifunction peripheral device 1 deletes the facsimile data from the facsimile data memory 14*b* and returns to S2. Since the multifunction peripheral device 1 executes a printing operation based on the facsimile data from the first page to the final page in S236, it is possible to obtain acceptable printing results for all pages, even when the printing results for the first page printed in S222 were unacceptable.

In the facsimile data printing process according to the second embodiment, only the first page worth of facsimile data is printed in order to determine printing results, while the remainder of the printing operation is executed when the printing results are determined allowable. Therefore, it is possible to reduce the unnecessary consumption of recording paper P when printing problems occur that are unacceptable because the purge process was not executed.

It is noted that when printing complications occur due to the purge process not being executed, these printing complications are most apparent at the beginning of the printing operation. Therefore, it is preferable to print the first page worth of facsimile data in order to determine printing results.

Further, even when printing problems occur due to not executing the purge process, only one page worth of the recording paper P is wasted, as described above. In this case, the user can execute the purge process after noticing the printing complications. As a result, the multifunction peripheral device 1 reduces the number of times the purge process is executed, thereby suppressing ink consumption.

Further, since the multifunction peripheral device 1 maintains the facsimile data in the facsimile data memory 14*b* until the remaining printing operation from the second page to the final page is performed in S230 or until the entire printing operation is performed in S236, the multifunction peripheral device 1 can reliably obtain printing results that are sufficiently acceptable to the user or printing results achieved by reprinting the facsimile data after executing a purge process, even when printing problems occur, thereby reducing problems associated with the occurrence of printing complications.

While the printing process in the first and second embodiments described above relate to printing facsimile data, the printing process can be modified to a printing process for other functions that use the inkjet printer 26, such as the printer function and copier function.

Next, a printing process for a printer or copier function that is executed on the multifunction peripheral device 1 according to a third embodiment will be described with reference to FIG. 6. FIG. 6 is a flowchart illustrating steps in the printer or copier printing process of the third embodiment. While the facsimile data printing process described in the first and second embodiments is executed when printing facsimile data, the printer or copier printing process of the third embodiment is executed when printing data inputted from the personal computer 53 or when printing image data read by the scanner 19.

Data inputted from the personal computer 53 is converted to bit image data, for example, and stored in the image memory 29, while image data scanned by the scanner 19 is also stored in the image memory 29. Hereinafter, both the bit image data and image data stored in the image memory 29 will be referred to as "print data." If there is no danger that printing complications will occur without executing the purge process, the print data stored in the image memory 29 is deleted from the image memory 29 after the inkjet printer 26 prints the data on recording paper. However, if a purge process is necessary, that is, if printing problems may occur without executing the purge process, the print data is saved in the image memory 29 after the inkjet printer 26 prints the data on recording paper.

In S72 of FIG. 6, the multifunction peripheral device 1 determines whether or not a print command has been issued from the personal computer 53 or whether or not a copy command has been issued via the control panel 3. If neither a print command nor a copy command has been issued (S72: NO), the multifunction peripheral device 1 repeats the process of S72. When a print command or a copy command has been issued, the print data is stored in the image memory 29.

Upon receiving a print command or a copy command (S72: YES), the multifunction peripheral device 1 determines the necessity of a purge process by determining whether or not the prescribed conditions for performing the purge process have been met. Since the process of S74-S80 for determining whether the prescribed conditions indicating the necessity of a purge process have been met are identical to the process of S4-S10 in the first embodiment (see FIG. 4), a description of this process has been omitted. If the multifunction peripheral device 1 determines that a purge process is unnecessary (S80: NO), then in S82 the multifunction peripheral device 1 executes a printing operation based on the print data stored in the image memory 29. The printing operation of S82 is performed for all pages from the first to the last page. After printing all pages in S82, in S84 the multifunction peripheral device 1 deletes the print data from the image memory 29.

However, if the multifunction peripheral device 1 determines that a purge process is necessary at any of the steps of S74-S80 (Yes in S74, No in S76, Yes in S78, or Yes in S80), the multifunction peripheral device 1 advances to S86. In S86 the multifunction peripheral device 1 prints the first page in the printing operation based on the print data.

In S88 the multifunction peripheral device 1 displays a message such as "Are the printing results satisfactory?" on the LCD 6, asking the user whether or not the printing results are allowable. In response, the user performs a prescribed operation on the control panel 3. If the user responds that the printing results are allowable, for example, by responding "Satisfactory" (S90: YES), then in S92 the multifunction peripheral device 1 prints the remaining portion (from the second page to the last page) of the print data that has not been printed in S86. Thus, since the first page of the printing operation was completed in S86 and the printing results of that operation were allowable, the multifunction peripheral device 1 continues the printing operation by printing the remaining portion from the second page to the last page. In this way, the multifunction peripheral device 1 obtains satisfactory printing results for all pages in the printing operation including the printing results from the process performed in S86 and the printing results from the process performed in S92. Accordingly, in S100 the multifunction peripheral device 1 deletes the print data from the image memory 29 and returns to S72.

On the other hand, if the user responds that the printing results are not allowable, for example, by indicating "Not satisfactory" (S90: NO), in S94 the multifunction peripheral device 1 executes the purge process. By automatically performing the purge process upon receiving a response from the user that the printing results are not allowable, the multifunction peripheral device 1 can reduce the user workload. In S96 the multifunction peripheral device 1 updates the time for executing the purge process that is stored in the purge timing memory 14*a*.

In S98 the multifunction peripheral device 1 executes a printing operation based on the print data stored in the image memory 29 from the first page to the last page. Since a purge process was executed in S94 prior to performing the printing operation in this case, it is highly unlikely that printing problems will occur and highly likely that satisfactory printing results can be obtained. Therefore, in S100 the multifunction peripheral device 1 deletes the print data from the image memory 29 and returns to S72. Since the multifunction peripheral device 1 executes a printing operation based on the print data from the first page to a last page in S98 when printing results for the first page printed in S86 were not allowable, the multifunction peripheral device 1 can still obtain allowable printing results for all pages.

In the printer or copier printing process of the third embodiment, the multifunction peripheral device 1 prints only the first page of the print data for determining printing results and prints the remaining pages if the printing results are acceptable. Therefore, the multifunction peripheral device 1 can reduce unnecessary consumption of the recording paper P when unacceptable printing problems occur because the purge process was not executed.

Further, even when printing problems occur due to not executing the purge process, only one page worth of the recording paper P is wasted, as described above. In this case, the user can execute the purge process after noticing the printing complications. As a result, the multifunction peripheral device 1 reduces the number of times the purge process is executed, thereby suppressing ink consumption.

Further, by saving the print data in the image memory 29 until the remaining pages of the printing operation from the second page to the final page are printed in S92 or until the entire printing operation is performed in S98, the multifunction peripheral device 1 can reduce the user's workload and the number of operations required by the user. In other words, depending on whether the user allows the printing results or does not allow the printing results after viewing the first page printed in S86, the user can perform prescribed operations on the control panel 3 to print the remaining pages from the second page to the final page in S92 or to print all pages in S98. This eliminates the need for the user to run back and forth between the personal computer 53 and the multifunction peripheral device 1 when executing a printing operation from the personal computer 53, for example.

In the above description, the multifunction peripheral device 1 can perform the printing operation of FIG. 6 in both of the printer function and the copier function. However, the multifunction peripheral device 1 may be modified to perform the printing operation of FIG. 6 only in one of the printer function and the copier function.

Further, the multifunction peripheral device 1 can perform both of the printer or copier printing process according to the third embodiment and the facsimile data printing process of the first embodiment or the second embodiment.

While the invention has been described in detail with reference to the above aspects thereof, it would be apparent to those skilled in the art that various changes and modifications may be made therein without departing from the spirit of the invention.

For example, in the first and second embodiments described above, all of the facsimile data received from another facsimile machine is stored in the facsimile data memory 14*b*. However, it is also possible to store the facsimile data in the facsimile data memory 14*b* only when a purge process is determined to be necessary based on the determinations in S4-S10.

In the second and third embodiments described above, the user is prompted to indicate whether or not printing results are allowable after printing one page worth of print data. However, the amount of data printed before querying the user is not limited to one page worth, but merely need be a portion of the entire print data. For example, it is possible to print less than one page worth of print data or more than one page worth of print data, provided that the amount of data is sufficient for determining printing results.

The purge process described in the embodiments restores the ink ejection state of the print head 65 by drawing ink out of the nozzles in the print head 65. However, the purge process may be modified to restore the ink ejection state of the print head 65 by ejecting ink through the nozzles thereof. The ink ejection state of the print head 65 can be restored by thus positively flowing ink through the nozzles thereof.

In the above-described embodiments, the multifunction peripheral device 1 includes the facsimile function, printer function, scanner function, copier function, and video printer function. However, the multifunction peripheral device 1 may be modified to other various types of inkjet printer that perform one or more of the facsimile function, printer function, copier function, and video printer function.

What is claimed is:

1. An inkjet printer comprising:

a print head formed with at least one ink ejection opening for printing on a recording medium by ejecting ink from the ink ejection opening;

a print data storing unit that stores inputted print data;

a print executing unit that executes a printing operation with the print head based on print data stored in the print data storing unit;

a maintaining unit that restores an ink ejection state of the print head by flowing ink through the ink ejection opening formed in the print head;

a maintenance necessity determining unit that determines whether or not it is necessary to perform an operation for restoring the ink ejection state with the maintaining unit; and a printing results inquiring unit that issues a request to a user to indicate whether the printing results of a printing operation executed by the print executing unit are of satisfactory quality when the maintenance necessity determining unit determines that it is necessary to restore the ink ejection state of the print head, the print data storing unit storing print data at least until a response indicating that the printing results are of satisfactory quality is received in response to the request to the user, or at least until the maintaining unit has executed an operation to restore the ink ejection state and the print executing unit has repeated the printing operation after the printing results inquiring unit has issued the request to the user.

2. An inkjet printer according to claim 1, wherein the maintaining unit restores the ink ejection state of the print head by ejecting ink from the ink ejection opening formed in the print head.

3. An inkjet printer according to claim 1, wherein the maintaining unit restores the ink ejection state of the print head by drawing ink from the ink ejection opening formed in the print head.

4. An inkjet printer according to claim 1, further comprising a maintenance executing unit that executes an operation with the maintaining unit to restore the ink ejection state when a user responds to the request by indicating that the printing results are of unsatisfactory quality.

5. An inkjet printer according to claim 4, wherein the print executing unit re-executes a printing operation based on print data stored in the print data storing unit after the maintenance executing unit has executed an operation to restore the ink ejection state;

the printing results inquiring unit issues another request to the user to indicate whether the printing results are of satisfactory quality after the print executing unit re-executes a printing operation; and the print data storing unit stores the print data at least until there is a response to the another request that the printing results are of satisfactory quality.

6. An inkjet printer according to claim 1, wherein the maintaining unit restores the ink ejection state of the print head by ejecting or drawing ink from the ink ejection opening formed in the print head.

7. An inkjet printer comprising:

a print data storing unit that stores inputted print data;

a print head formed with at least one ink ejection opening for printing on a recording medium based on the print data stored in the print data storing unit by ejecting ink through the ink ejection opening;

a maintaining unit that restores an ink ejection state of the print head by flowing ink through the ink ejection opening formed in the print head;

a maintenance necessity determining unit that determines whether or not it is necessary to perform an operation for restoring the ink ejection state with the maintaining unit;

a partial print executing unit that executes a printing operation based on a part of print data stored in the print data storing unit when the maintenance necessity determining unit determines that an operation for restoring the ink ejection state is required;

a printing results inquiring unit that issues an inquiry regarding whether printing results of the partial print executing unit are of satisfactory quality; and a remaining print executing unit that executes, when a response to an inquiry by the printing results inquiring unit indicates that the printing results are of satisfactory quality, a printing operation based on a remaining part of the print data that is stored in the print data storing unit but that has not been printed by the partial print executing unit.

8. An inkjet printer according to claim 7, wherein the maintaining unit restores the ink ejection state of the print head by ejecting ink from the ink ejection opening formed in the print head.

9. An inkjet printer according to claim 7, wherein the maintaining unit restores the ink ejection state of the print head by drawing ink from the ink ejection opening formed in the print head.

10. An inkjet printer according to claim 7, further comprising a maintenance executing unit that executes an operation with the maintaining unit to restore the ink ejection state when there is a response to an inquiry by the printing results inquiring unit that the printing results are of unsatisfactory quality.

11. An inkjet printer according to claim 10, further comprising a print re-executing unit that executes a printing operation, after the maintenance executing unit has executed an operation to restore the ink ejection state, to reprint the part already printed by the partial print executing unit and to print the unprinted part not printed by the partial print executing unit.

12. An inkjet printer according to claim 11, wherein the print data storing unit stores print data at least until an unprinted part of print data has been printed by either one of the remaining print executing unit and the print re-executing unit.

13. An inkjet printer according to claim 7, wherein the maintaining unit restores the ink ejection state of the print head by ejecting or drawing ink from the ink ejection opening formed in the print head.

14. A method of maintaining an ink ejection state of a print head in an inkjet printer, the inkjet printer including the print head formed with at least one ink ejection opening for printing on a recording medium by ejecting ink from the ink ejection opening, a print data storing unit that stores inputted print data, a print executing unit that executes a printing operation with the print head based on print data stored in the print data storing unit, and a maintaining unit that restores an ink ejection state of the print head by flowing ink through the ink ejection opening formed in the print head, the method comprising:

determining whether or not it is necessary to perform an operation for restoring the ink ejection state with the maintaining unit;

issuing a request to a user to indicate whether the printing results of a printing operation executed by the print executing unit are of satisfactory quality when it is determined that it is necessary to restore the ink ejection state of the print head; and storing print data at least until a response indicating that the printing results are of satisfactory quality is received in response to an inquiry by the printing results inquiring unit, or at least until the maintaining unit has executed an operation to restore the ink ejection state and the print executing unit has repeated the printing operation after the printing results inquiring unit has issued the request to the user.

* * * * *